US005772622A

United States Patent [19]

Friske

[11] Patent Number: 5,772,622

[45] Date of Patent: Jun. 30, 1998

[54] GRAVITY INVERSION BELT

[76] Inventor: John A. Friske, 3318 Spring Creek La., Dunwoody, Ga. 30350

[21] Appl. No.: 715,003

[22] Filed: Sep. 17, 1996

[51] Int. Cl.[6] ..... A61H 1/02

[52] U.S. Cl. ..... 602/36; 606/241; 428/99

[58] Field of Search ..... 428/99; 482/43, 482/143, 144, 907, 69; 602/36; 606/241

[56] References Cited

U.S. PATENT DOCUMENTS

| | | | |
|---|---|---|---|
| 3,379,439 | 4/1968 | Sorenson et al. | 272/64 |
| 3,761,082 | 9/1973 | Barthel | 482/69 |
| 4,396,012 | 8/1983 | Cobiski | 128/75 |
| 4,976,623 | 12/1990 | Owsley | 434/247 |
| 5,360,384 | 11/1994 | Toensing | 482/43 |
| 5,403,270 | 4/1995 | Schipper | 602/36 |

*Primary Examiner*—Alexander Thomas
*Attorney, Agent, or Firm*—Thomas, Kayden, Horstemeyer & Risley

[57] ABSTRACT

The body support harness (10) includes an outer strap supported belt (11) placed in the hem (19) of a support assembly (12). The apron (18) suspended between the straps (15 and 16) limits the rotation of the person to approximately 180°, so that the person can enter the harness in a standing, upright attitude (FIG. 7), and tilt himself to an inverted attitude (FIG. 8), with the apron (18) limiting movement beyond the legs achieving an upright attitude.

8 Claims, 4 Drawing Sheets

GRAVITY INVERSION BELT

FIELD OF THE INVENTION

This invention relates to a harness that includes a belt that surrounds the waist of the human body, with a pair of straps, each connected at one end to the belt and extending upwardly from the belt for connection to a horizontal support, for suspending the body and allowing the body to become inverted while suspended.

BACKGROUND OF THE INVITATION

There are times when a person would like to stretch the vertebrae of the backbone to urge the vertebrae apart so as to rest the back. This has the potential of being therapeutic and allows the person to treat and rest the vertebrae and alleviate back stress and fatigue.

In order to stretch the back some people desire to be suspended in an inverted attitude, with head suspended adjacent the floor and feet extending upwardly from the torso. Boots have been used in the past for inverting the human body. The wearer dons the boots and connects the boots to an overhead support and suspends himself from the boots. The body is stretched as the person remains suspended by his/her feet, but a large proportion of the weight of the body is applied to the knees and ankles, which in some instances is undesirable. Also, it is difficult to control the body when the body is suspended by the feet. If the body is suspended at the waist in an inverted attitude, the pelvic area supports the body as gravity pulls the upper torso downwardly, alleviating back tension or stress. In the meantime, the body is more controllable and tension is not applied to the knees or ankles.

Various combinations of belts and straps have been developed in the past which allow a person to suspend him or her self in an inverted attitude. For example, U.S. Pat. Nos. 3,379,439, 4,976,623, and 5,360,384 each show a belt and straps connected to the belt for connecting to higher objects so that a person cinched in the belt can be suspended above the floor or ground. Belts of this type are used in the training of athletes, particularly when teaching tumbling, trampoline or other gymnastic events so as to support the athlete while performing different exercises. The belts and their straps allow the person to suspend him or her self by the waist or chest while turning flips, somersaults, etc.

The prior art known to the inventor does not include a simple suspension belt assembly that allows the person wearing the belt to suspend him or her self above the floor in an inverted position so that the person can substantially relax in an inverted attitude safely above the floor, in a condition of rest, without hazard of inadvertently flipping over or tumbling out of the desired position. Further, the prior art does not teach a suspension belt system which allows the person wearing the belt to substantially relax while maintaining a stationary inverted position and to naturally pivot toward an upright position upon allowing gravity to fold the legs of the body, thus shifting the center of gravity of the body so as to naturally return the body to an upright attitude.

SUMMARY OF THE INVENTION

Briefly described, the present invention comprises a body support harness which includes a belt for cinching about the waist of a person, and a support assembly connected to the belt at the sides and rear of the person and extending upwardly from the person for connection to an overhead horizontal support. In the preferred embodiment of the invention, the belt comprises an inner body protective belt for surrounding the torso and a strap supported outer belt for surrounding the inner body protective belt. The support assembly includes a pair of support straps, each connected at one end to the outer belt and extending upwardly approximately parallel to each other from the sides of the outer belt and connected at their other ends to hooks, with the hooks being positioned over a horizontal chin-up bar or to the end of a tiltable inversion table or to some other horizontal support.

The support assembly also includes an apron having opposed sides, with the opposed sides each being connected along its length to one of the support straps, so that the apron is suspended vertically between the straps and extends above the belt assembly. The support straps extend upwardly beyond the upper limits of the apron, so that the upper edge of the apron is displaced downwardly from the hooks of the straps and the horizontal support a distance sufficient for the occupant of the belt to place his ankles behind the horizontal support and hook his feet over the horizontal support so as to allow the occupant of the belt to easily maintain an inverted attitude while suspended by the belt assembly.

A feature of the apron is that the person occupying the belt cannot pivot his or her body more than approximately 18°, between an upright position and an inverted position. This permits the person who occupies the belt to stand upright with his back adjacent the apron as he cinches himself in the belt and then suspend himself and tilt himself so that his torso moves downwardly away from the apron as his legs rise up to engage the apron, to completely invert his or her body until his/her legs engage the apron, whereupon the legs are not permitted to move any farther, causing the person to remain in an inverted attitude. Further, the displacement of the upper edge of the apron from the horizontal support provides enough space for the feet of the occupant of the belt to move behind the horizontal support, so that the occupant does not inadvertently rotate back to an upright position with a slight shift of his center of gravity.

Another important feature of the invention is that should the occupant while supported in an inverted attitude by the body support harness, with feet hooked behind the horizontal support, simply relax his/her legs, so that the forces of gravity tend to cause the legs to fold downwardly away from the horizontal support, the apron prohibits the legs and buttocks from tilting toward the apron, causing the knees and other portions of the legs to fold away from the apron, thereby shifting the center of gravity of the occupant so that the body begins to tilt back toward an upright attitude.

Another feature of the body support harness is that it can be used in combination with an inversion table, by connecting the support straps to an end of the inversion table, instead of connecting the person's feet to the end of the inversion table. This allows the legs of the person to remain free while using the inversion table.

Thus, it is an object of this invention to provide an improved body support harness for suspending the human body from an overhead support in an inverted attitude, whereby the occupant of the harness can easily maintain an inverted attitude without strenuous effort or concentrated balancing, but which allows the occupant to easily reassume an upright attitude by simply relaxing and folding his/her legs.

Another object of this invention is to provide an improved body support harness for use in stretching the back of an occupant of the harness, which is safe and expedient to use, which includes a minimum of hardware, and which can be conveniently folded and stored between uses.

Other objects, features and advantages of the invention will become apparent upon reading the following specifications, when taken in conjunction with the accompanying drawings.

DETAILED DESCRIPTION

Figure 1:
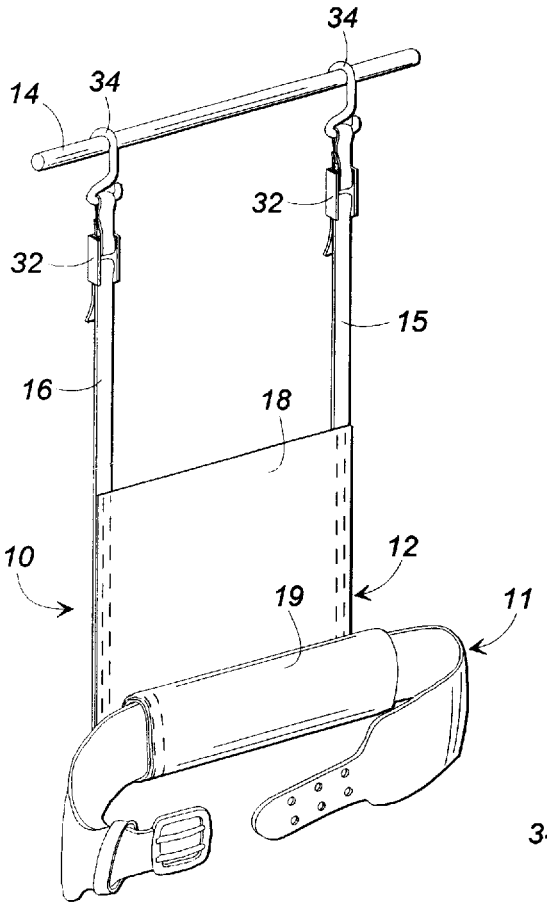
FIG. 1 is a perspective illustration of the body support harness, showing the harness suspended from an overhead horizontal chin-up bar.

Referring now in more detail to the drawings, in which like numerals indicate like parts throughout the several views, FIG. 1 illustrates a portion of the body support harness 10 which includes strap supported outer belt 11 and a support assembly 12 which extends from the belt 11 up to a horizontal support, such as the chin-up bar 14 placed in the upper portion of a door jamb 50 of a house. The support assembly 12 includes a pair of side-by-side, usually parallel support straps 15 and 16, an apron 18 which is connected at its side edges to the lower portions of the support straps 15 and 16. The apron and support straps are folded over at their lower ends to form an open-ended belt receiving hem 19. The belt 11 is simply slid through the hem 19, so that it is supported primarily by the support straps 15 and 16.

Figure 2:
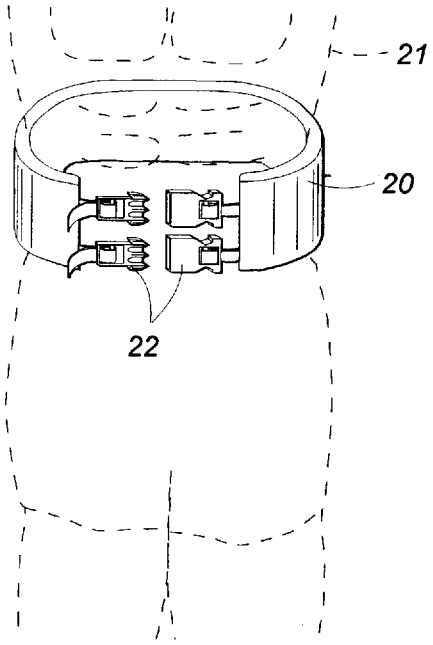
FIG. 2 is a perspective illustration of the inner body protective belt that is worn about the waist of the person to be suspended in the body support harness.
Figure 3:
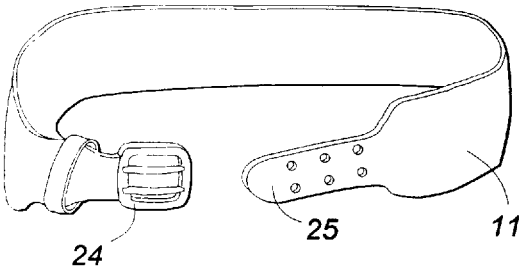
FIG. 3 is a perspective view of the strap supported outer belt that is to be cinched about the inner body protective belt.

As illustrated in FIG. 2, the body protective inner belt 20 is cinched about the waist of the person or occupant of the harness, with the outer belt 11 to be cinched about the inner belt 20. The inner belt is formed of a compressible plastic foam, with conventional clasps 22 arranged to fasten the inner belt about the waist of the wearer. When the protective inner belt 20 is in position about the waist of the wearer, the outer belt 11 is threaded through the hem 19 of the support assembly 12 and is cinched about the inner belt 20. The inner belt thus cushions the body from abrasion or gouging that might be caused by direct contact of the outer belt against the body of the wearer 21. The outer belt 11 includes a buckle 24 and a tongue 25 having holes therein for receiving the prongs of the buckle, in a conventional fashion.

Figure 7:
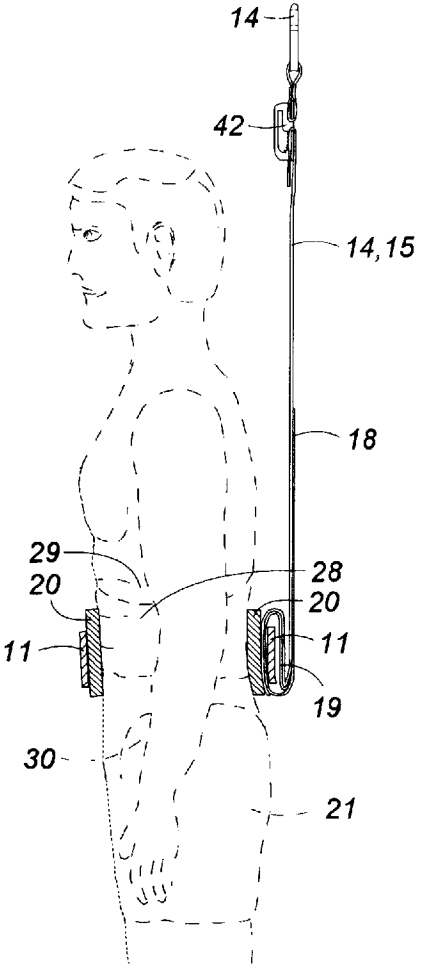
FIG. 7 is a side view, in cross section, of the body protective inner belt and the strap supported outer belt, as positioned at the waist of the wearer, above the pelvic bones and below the rib cage of the wearer and the outer belt extended through the hem of the support assembly.

As shown in FIG. 7, the body protective inner belt 20 is worn at the waist 28 of the person, between the lower rib cage 29 and the upper pelvic area 30, with the inner belt completely shielding the wearer from the outer belt 11.

Figure 4:
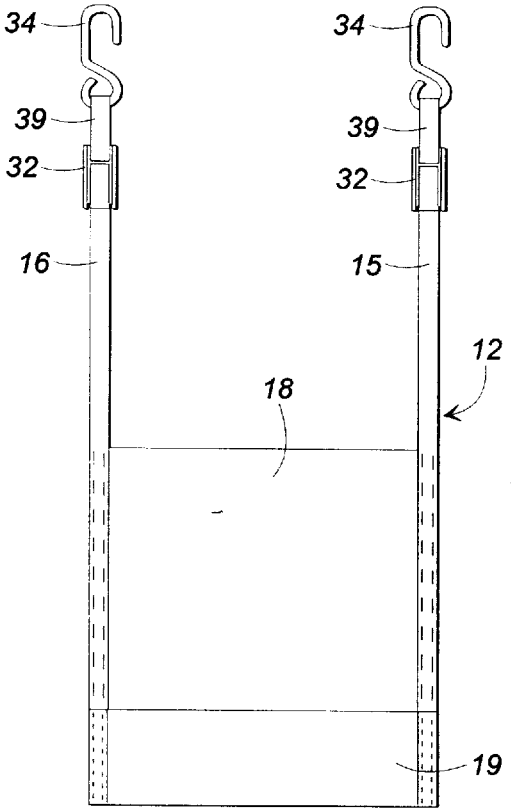
FIG. 4 is a front view of the support assembly that is connected to the outer strap supported belt.
Figure 6:
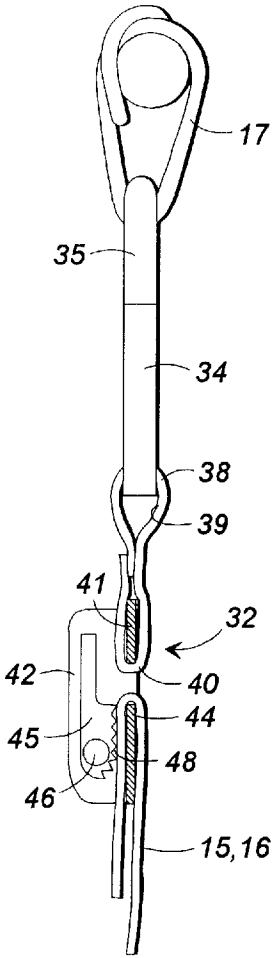
FIG. 6 is a side view of the connector of FIG. 5.
Figure 5:
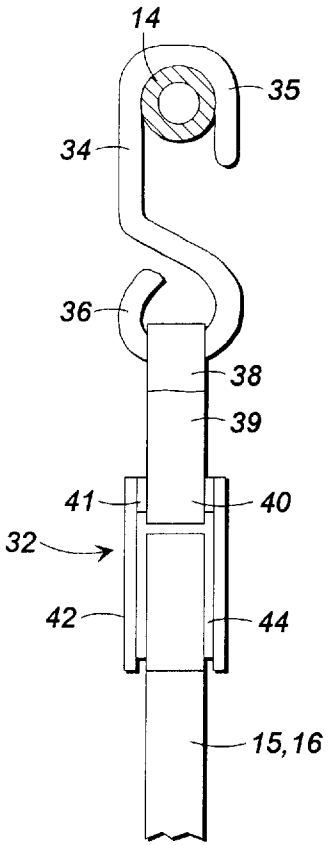
FIG. 5 is a front view of one of the straps and its hook that connects to the horizontal support.

As illustrated in FIGS. 4, 5 and 6, the support straps 15 and 16 each include an adjustable attachment means 32 at its upper end. As shown in FIGS. 5 and 6, the adjustable attachment means includes an S-hook 34 having an open hooked end 35 that is sized and shaped to extend about a horizontal support, such as a chin-up bar 14, and a lower closed end 36 for receiving the upper loop 38 of a double loop strap 39. The lower loop 40 of the double loop strap 39 extends about a connector bar 41 of buckle 42. Buckle 42 also includes a belt clasp plate 44, and the upper end of the strap 15 or 16 extends about the belt clasp plate 44. Clasp 45 is rotatable about the pivot pin 46, and its serrated teeth 48 engage the free end of the strap 15 or 16, holding the strap firmly to the buckle 42. With this arrangement, the height at which the outer belt 11 is suspended from the floor can be adjusted.

As illustrated in FIG. 7, when the body support harness is to be worn by the wearer 21, the wearer first connects the harness to the horizontal support 14 and then adjusts the buckles 42 so that the outer strap supported belt 11 is located at waist height of the wearer. The wearer then dons the inner body protective belt 20 (FIG. 2) and then inverts the outer strap supported belt 11 and the hem 19 (FIGS. 1 and 7) and moves into the strap supported outer belt 11 of FIG. 1 and cinches the belt 11 about his waist.

Figure 8:
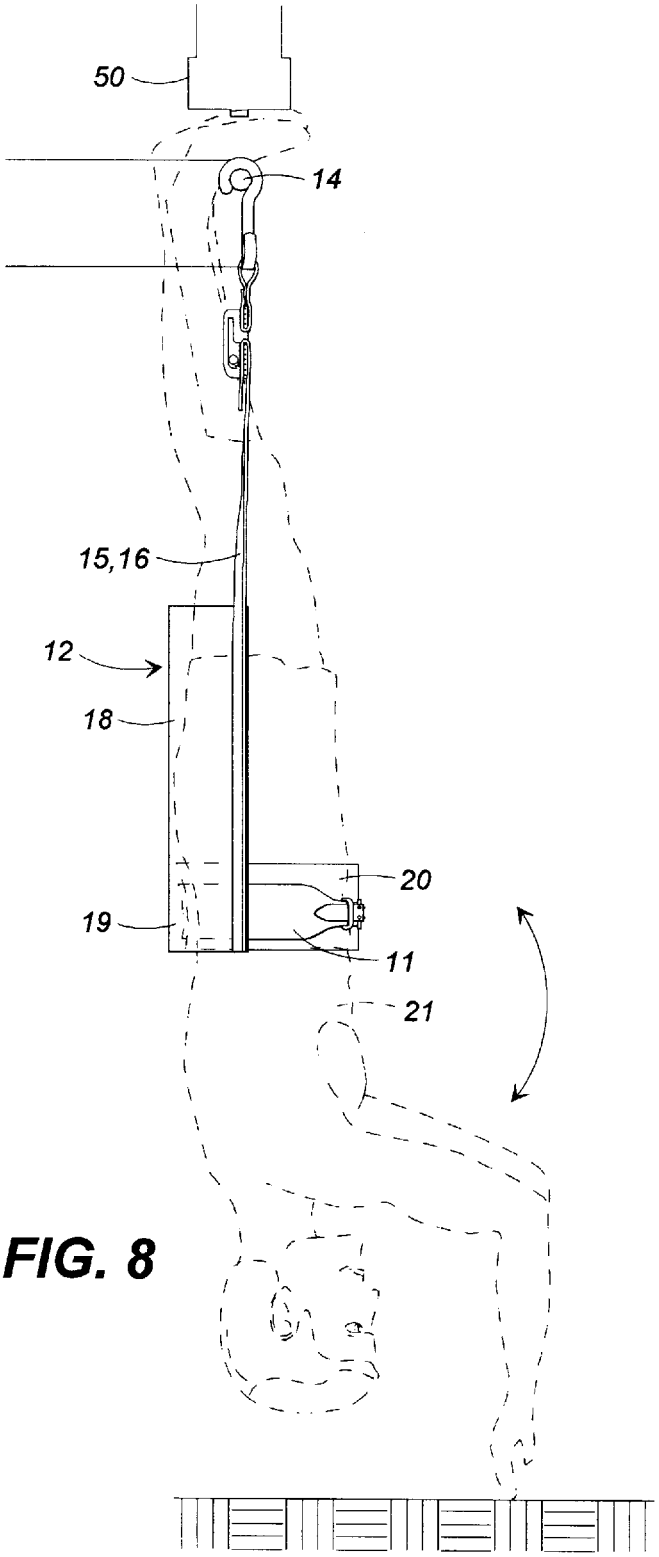
FIG. 8 is a side view of the body support harness, showing a person occupying the harness in an inverted attitude, with feet positioned above the upper edge of the apron and hooked behind the horizontal support bar.

As illustrated in FIG. 8, the wearer can then allow his body to become supported by the harness, by bending his knees and lowering his torso, and then the wearer can bend forward so that his hands and arms approach the floor while his legs tilt upwardly toward the upper horizontal support 14, until the buttocks and thighs of the wearer engage the apron 18 and his upper torso and head are suspended below the belt. The apron thus prevents the occupant of the harness from tilting more than 180°, therefore controlling the rotation of the occupant in the harness. If desired, the occupant can move his feet and calves over the top of the apron 18 so that his feet can hook over the horizontal support 14. Typically, the horizontal support 14 will be an expandable two-piece bar, known as a chin-up bar, of the type that would be expanded into compression mounted in the opening of a doorway 50, with the bar 14 being placed low enough so as to permit the toes of the feet to extend over the bar. With this arrangement, the occupant of the harness could retain a static position, with the apron 18 limiting rotation in one direction, and the bar 14 limiting rotation in the other direction.

When the occupant relaxes his/her legs, so that the legs fold downwardly from the bar 14, the usual tendency is for the legs to fold in front of the torso, changing the center of gravity of the occupant, so that the occupant tends to rotate back toward an upright attitude.

The body support harness, therefore, functions as a gravity inversion belt, in the sense that the occupant of the belt can, by shifting weight and by engaging the floor with his hands or feet, achieve and inverted attitude, and gravity tends to stretch the spine so as to relieve tension, stress, etc.

As illustrated in the drawings, the apron can be formed of woven sheet material which is flexible so that it can be folded and conveniently stored or carried in a tote bag. The apron can be formed of other materials, in the form of net material or various textiles or plastics which are suitable for the functions herein described.

Further, the hem at the lower portio of the apron through which the outer belt extends tends to limit the rotary movement of the body to 180°. The straps support the body while the body rotates and when the body reaches the 180° limit of rotation, the hem prevents the back span of the belt from moving below the level of the side spans of the belt.

Figure 9:
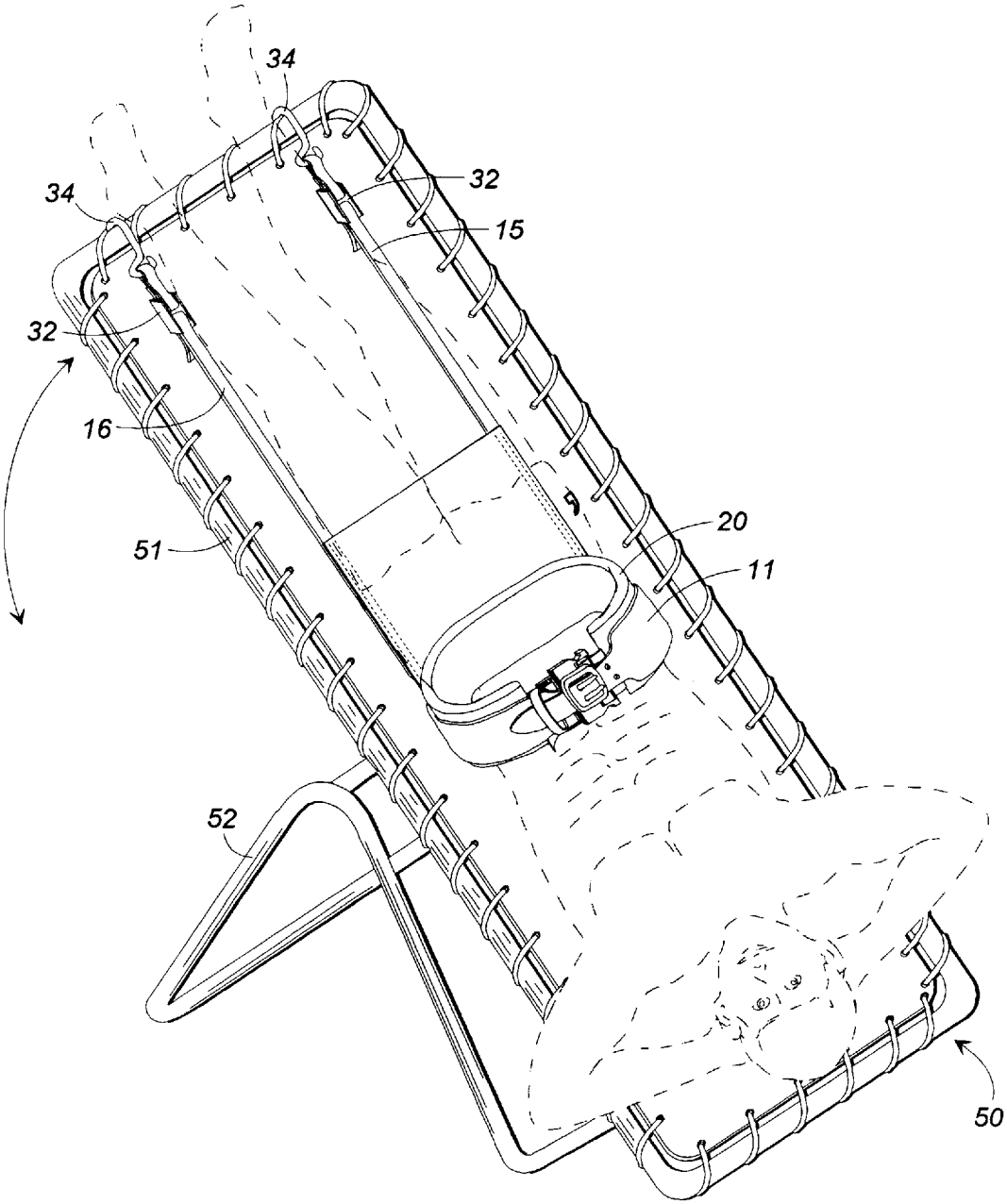
FIG. 9 is a perspective view of the body support harness in use with a body inversion table.

As illustrated in FIG. 9, the body support harness can be used in combination with an inversion table 50. The inversion table includes a platform 51 pivotably supported intermediate its ends by stationary support stand 52. The hooks 34 of the harness are attached to one end of the table, and the wearer cinches the belts 20 and 11 about his waist in the manner illustrated in FIG. 8, without inverting the outer belt 11 and hem 19. The wearer then tilts the inversion table to raise his feet above his torso. With this arrangement the legs of the wearer are free to be moved and no tension is applied to the ankles and knees.

While the present invention has been described in detail with respect to a preferred embodiment, it will be understood by those skilled in the art that numerous modifications, additions and deletions can be made thereto without departing from the spirit and scope of the invention as set forth in the following claims.

We claim:

1. A body support harness for suspending the human body from a horizontal support in an inverted attitude comprising:

a belt for encircling and strapping about the waist of the human body;

a pair of elongated support straps each connected at one of its ends to said belt and spaced from each other about said belt for supporting the belt at opposite sides of the torso of the human body;

attachment means connected to the other end of each of said straps for connection to a horizontal support;

an apron having opposed sides and opposed upper and lower ends, said apron being attached along its opposed sides to said support straps and with said lower end of said apron connected to said belt and said upper end of said apron extending away from said belt a distance to prevent the movement of the torso of the human body when supported at the waist by the belt to pass between said straps, said attachment means being displaced from said apron for forming a gap between the apron and the horizontal support to which the attachment means are attached for the placement of the lower legs of the human body;

whereby a person attaches the attachment means to a horizontal support higher than the height of the person, the person fastens the belt about his waist and suspends himself at the waist in the harness, with the torso of his body adjacent the apron, then pivots his upper torso downwardly away from the apron and from the horizontal support and his thighs and buttocks upwardly toward the apron and toward the horizontal support with his legs and feet movable into the gap above the apron, and the apron retards the pivotal movement of the thighs and buttocks of the person's body beyond an upright attitude.

2. The body support harness of claim 1 and wherein said belt comprises an inner body protective belt for surrounding the torso and an outer strap supported belt for surrounding the inner body protective belt, said support straps being connected to said outer strap supported belt.

3. The body support harness of claim 1 and wherein said attachment means comprises a rigid hook for mounting about the horizontal support.

4. The body support harness of claim 1 and wherein said apron is formed of woven sheet material.

5. The body support harness of claim 1 and wherein said apron is of a breadth between said support straps to maintain said support straps approximately parallel to each other when suspended from the horizontal support.

6. The body support harness of claim 1 and wherein said horizontal support comprises an inversion table, and said attachment means connected to said inversion table.

7. A body support harness for suspending the human body from an overhead support in an inverted attitude comprising:

a belt sized and shaped for encircling and strapping about the waist of the human body and including a buckle and tongue for connection at the front of the waist of the human torso, and a rear span for mounting at the back of the human torso;

a support assembly connected to said belt and for connection to an overhead support and suspending said belt;

said support assembly including an apron extending upwardly from said belt and having opposed upright sides and upper and lower ends, said lower end of said apron mounted to said belt and extending along the rear span of said belt said apron extending upwardly from said belt a distance to block the movement of the torso of the human body to move beyond a vertical attitude; and adjustable attachment means for connection between said apron and said overhead support;

whereby a person attaches the attachment means to an overhead support and fastens the belt about his waist and suspends himself at the waist in the harness, with the torso of his body adjacent the apron, then pivots his upper torso downwardly away from the apron and his legs and buttocks upwardly toward the apron, and the apron retards the pivotal movement of the thighs and buttocks of the person's body beyond a vertical attitude.

8. The body support harness of claim 7 and wherein said horizontal support comprises an inversion table, and said attachment means connected to said inversion table.

* * * * *